United States Patent [19]

Kitayama

[11] 4,223,593

[45] Sep. 23, 1980

[54] HYDRAULIC MOTOR

[75] Inventor: Hitoshi Kitayama, Yokohama, Japan

[73] Assignee: Ishikawajima-Harima Jukogyo Kabushiki Kaisha, Tokyo, Japan

[21] Appl. No.: 11,830

[22] Filed: Feb. 13, 1979

[30] Foreign Application Priority Data

Feb. 14, 1978 [JP] Japan ..... 53/14925

[51] Int. Cl.[3] ..... F01B 3/10

[52] U.S. Cl. ..... 91/477; 91/473

[58] Field of Search ..... 91/476, 477, 480

[56] References Cited

U.S. PATENT DOCUMENTS

| | | | |
|---|---|---|---|
| 3,435,774 | 4/1969 | Jarrett | 91/501 |
| 3,675,539 | 7/1972 | Zajac | 91/477 |
| 3,808,949 | 5/1974 | Mundie et al. | 91/473 |
| 3,862,587 | 1/1975 | Zajac et al. | 91/477 |

FOREIGN PATENT DOCUMENTS

| | | | |
|---|---|---|---|
| 2152096 | 4/1972 | Fed. Rep. of Germany | 91/480 |

*Primary Examiner*—William L. Freeh

*Attorney, Agent, or Firm*—Sughrue, Rothwell, Mion, Zinn and Macpeak

[57] ABSTRACT

Disclosed is a hydraulic motor with a nutating member. The nutating member mounted for nutation on a spherical surface bearing which in turn is mounted on a casing, has first and second bevel gears on respective end faces thereof, the first bevel gear on one end face being in mesh with a bevel gear rigidly mounted on the casing while the second bevel gear on the other end face being in mesh with a bevel gear carried rigidly by a shaft. A swash plate mounted on the casing for coaxial rotation with the shaft has an inclined end face against which said one end face of the nutating member is made to contact and being pressed thereagainst under the forces of pistons so that the swash plate with the inclined end face is caused to rotate, whereby the nutating member is made to nutate. Such nutation of the nutating member due to extension and retraction of the pistons under hydraulic pressure in a predetermined sequence results in the rotation of the shaft or the casing with respect to each other.

5 Claims, 3 Drawing Figures

HYDRAULIC MOTOR

FIELD OF THE INVENTION

The present invention relates to a hydraulically operated rotary machine with a nutating bevel gear transmission system or train therein, and more particularly, to an improvement thereof especially when used as a hydraulic motor.

BACKGROUND OF THE INVENTION

The hydraulically operated rotary machine or hydraulic motor with a nutating bevel gear transmission train therein is well known in the art and is advantageous over other types of hydraulic motors of comparable size in that low speed and high torque power may be derived and in that it may be readily converted into a hydraulic motor with a brake when a brake means is incorporated to retard and arrest the rotation of a shaft rotated at high speed.

However, it has also some disadvantages as will be described below.

(1) The bevel gear as a nutating member is rigidly and unrotatably carried by a crankshaft so that the dimensional accuracy of the crankshaft both in fabrication and assembly and the deflection thereof under load greatly affects not only the valve timing for for reciprocating pistons in a predetermined timed sequence, but the accuracy in meshing between the mating bevel gears. To overcome these problems, the component parts must be assembled with a higher degree of accuracy and the sub-assembly or the assembly must be adjusted also to a higher degree of accuracy. Thus the assembly requires a long time to manufacture.

(2) It is preferable that either the shaft or the casing is rotatable as needs demand, but the conventional hydraulic motors of the type described cannot rotate their casings while maintaining the shafts stationary.

(3) The space available for bearings journalling the output shaft is limited so that the capacity of the bearings and their mounting methods are limited. As a result, the load carried by the output shaft becomes inevitably low. Furthermore, in the prior art hydraulic motors of the type described, small bolts are used frequently in a power transmission train so that the problem of the durability arises. Moreover the rigidity of bolts used for joining between the casing and the valve unit as well as the rigidity of the casing itself present a problem.

Accordingly, one of the objects of the present invention is to overcome the above and other problems encountered in the prior art hydraulic motors of the type described without causing any sacrifice of their desirable features and advantages. The present invention will become apparent from the following description of the preferred embodiments thereof taken in conjunction with the accompanying drawings.

BRIEF DESCRIPTION OF THE DRAWINGS

The same reference numerals are used to designate similar parts throughout the figures.

DESCRIPTION OF THE PREFERRED EMBODIMENTS

Figure 1:
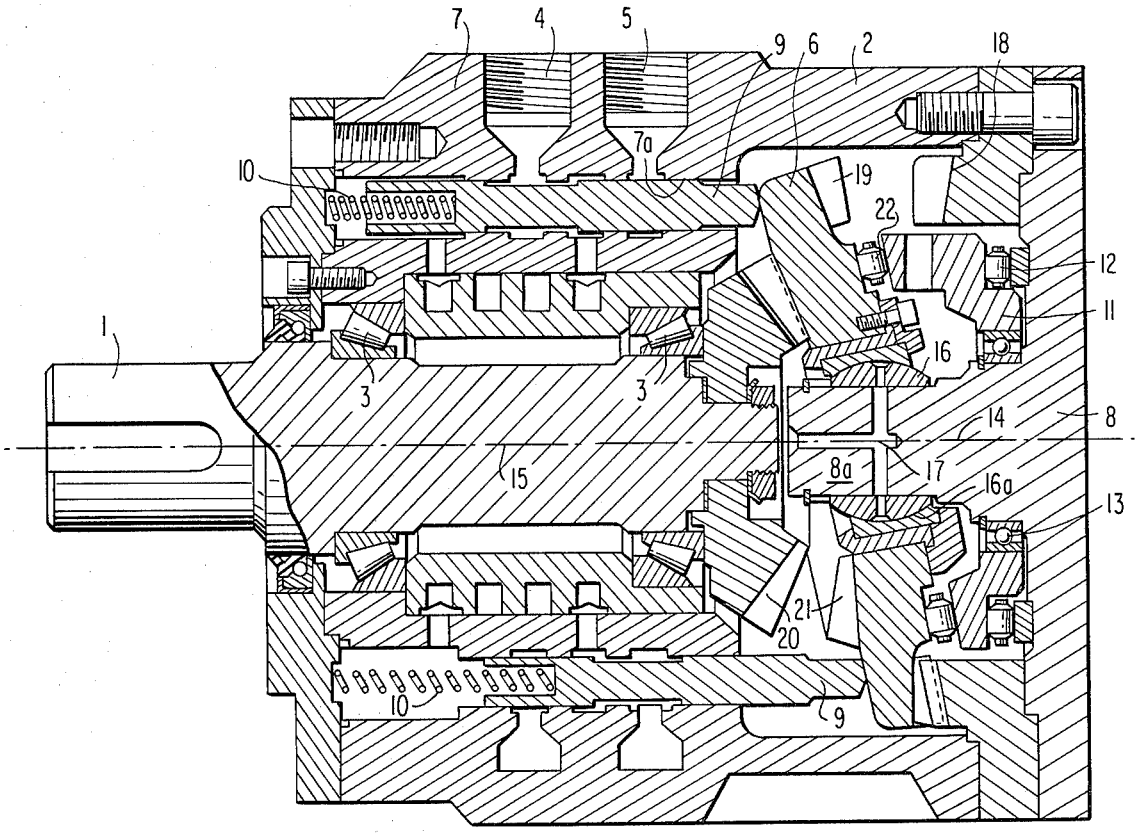
FIG. 1 is a sectional view, in elevation, of a first embodiment of the present invention.

First Embodiment, FIG. 1

A hydraulic motor shown in FIG. 1 is of the rotary shaft type and operates on a pressurized fluid such as a working liquid under pressure. It has an output shaft 1 of a suitable length, which is a rotary member. The output shaft 1 is extended lengthwise from the front (the right hand side in FIG. 1) to the rear side (the left hand side). More particularly the output shaft 1 is journalled in a casing 2, which is a stationary member, by means of a pair of axially spaced apart tapered roller bearings 3. The casing 2 is formed with a high pressure port 4 and a low pressure port 5, and includes a nutating member 6 and a valve unit 7. The front end of the casing 2 is closed with a front end cover 8 which forms a part of the casing 2.

The valve unit 7 is formed with 12 equiangularly spaced apart cylinder bores *7a* which are extended axially in parallel with the output shaft 1 and into which are fitted respective pistons 9 for reciprocal movement therein. The pistons 9 are biased by coiled springs 10 loaded in the bores *7a* so that the front end of the piston 9 normally is pressed against the rear end surface of the nutating member 6. In the first embodiment shown in FIG. 1, the pistons 9 function as the spools of three-way valves as is well known in the art of the hydraulic motors of the type described elsewhere, so that the bores which are spaced angularly apart from each other by 90° are hydraulically communicated with each other.

A rotating swash plate 11 with an inclined end face to be described in detail below is interposed between the nutating member 6 and the front end cover 8 and is rotatably mounted on the latter by means of a thrust bearing 12 and a radial ball bearing 13 in coaxial relationship with the output shaft 1. That is, the axis 14 of the swash plate 11 is coaxial or in line with the axis 15 of the output shaft 1. A bearing 16 with a spherical bearing surface 16*a* (to be referred to as "the spherical surface bearing" in this specification) is mounted on an extension extending from the inner surface of the front end cover 8 into the casing 2 in coaxial relationship with the swash plate 11 and the output shaft 1. The spherical bearing surface 16*a* of this bearing 16 is such that the center of radius of the spherical surface may be on the axis 14 of shaft 1. The nutating member 6 is so mounted on the spherical surface bearing 16 that the center of nutation thereof coincides with the center of radius of the spherical surface.

The nutating member 6 has a front bevel gear 19 formed or generated on the front end face thereof and in mesh with a bevel gear 18 securely interposed between the casing 2 and the front end plate 8. The nutating member 6 is also provided with a rear bevel gear 21, formed or generated on the rear end face thereof and progressively meshed with a bevel gear 20 rigidly mounted at the front end of the output shaft 1.

The rear end face of the rotating swash plate 11 is inclined at an angle to the vertical and is rolling contact with the inclined front end face of the nutating member 6 through a thrust bearing 22 to carry the thrust load.

When the pistons 9 push the nutating member 6 or when the pistons 9 are extended and retracted in a predetermined sequence, the front and rear bevel gears 19 and 21 thereon mesh with their mating bevel gears 18 and 20 and the swash plate 11 is axially pushed through the thrust bearing 22 and thus rotates, whereby the nutating member 6 nutates on the spherical surface bearing 16.

It is preferable that the bevel gears 18–21 are straight or spiral bevel gears, and there should be at least one tooth difference between the bevel gears 20 and 21.

Since the front bevel gear 19 on the nutating member 6 is in mesh with the bevel gear 18 which is held stationary, the rotation of the nutating member 6 is restricted. When the working liquid under high pressure is admitted through the high pressure port 4, the pistons 9 are reciprocated in a predetermined sequence to push the nutating member 6 and hence the rotatable swash plate 11 through the thrust bearing 22. As a result, the motion in the axial direction of the nutating member 6 is restricted. The pistons 9 equiangularly spaced apart from each other are extended and retracted in a predetermined sequence so that the swash plate 11 is made to rotate while being supported by the thrust and radial bearings 12 and 13. The rotation of the swash plate 11 results in the nutation of the nutating member 6 on the spherical surface bearing 16, the front and rear bevel gears 19 and 21 on the nutating member 6 meshing with the mating bevel gears 18 and 20 respectively. Due to the difference in tooth number between the bevel gears 20 and 21 as well as the reaction from the nutating member 6 whose rotation is restricted upon nutation, the bevel gear 20 and hence the output shaft 1, carrying the same, are rotated through an angle corresponding to the difference in number of teeth during nutation of the nutating member 6.

More particularly, the pistons 9, which are forced against the rear end face of the nutating member 6, function as the spools of the three-way valves in such a way that the high and low pressures may be exerted as the back pressures to the pistons 9 which are angularly spaced apart from each other by 90°. Therefore when the valve system made up of these pistons 9 and their associated component parts is combined with the nutation system made up of the nutating member 6 and its operatively coupled component parts in accordance with the present invention, the center of the combined force of the thrusts produced by the pistons 9 can be made to act on the midpoint between the upper and lower dead points of the nutating member 6. As a result the valve system brings about the reciprocating movement of the pistons 9, which in turn is converted into the nutation of the nutating member 6 through the swash plate 11 bearing the inclined rear end face which is maintained in the rolling contact with the front end face of the nutating member 6 through the thrust bearing 22.

In summary, as the working liquid under high pressure is admitted through the high pressure port 4, the pistons 9 are caused to reciprocate in the bores in a predetermined sequence, pushing the rear end face of the nutating member 6 so that the latter is caused to nutate which is guided by the swash plate 11 with the inclined rear end face. As a result, the bevel gear 20 and hence the output shaft 1 carrying the same are caused to rotate due to the number of teeth difference between the bevel gears 20 and 21. Thus, a low speed—high torque rotation of the output shaft 1 can be obtained. After having done work, the working liquid under high pressure, admitted through the high pressure port 4, drops in pressure and is discharged through the low pressure port 5.

To reverse the direction of rotation of the output shaft 1, the high pressure working liquid is admitted through the port 5 while the low pressure working liquid is discharged through the port 4. Then the pistons 9 are reciprocated in the reversed sequence so that the bevel gear 20 is rotated in the opposite direction and consequently the rotation of the output shaft 1 is reversed.

Figure 2:
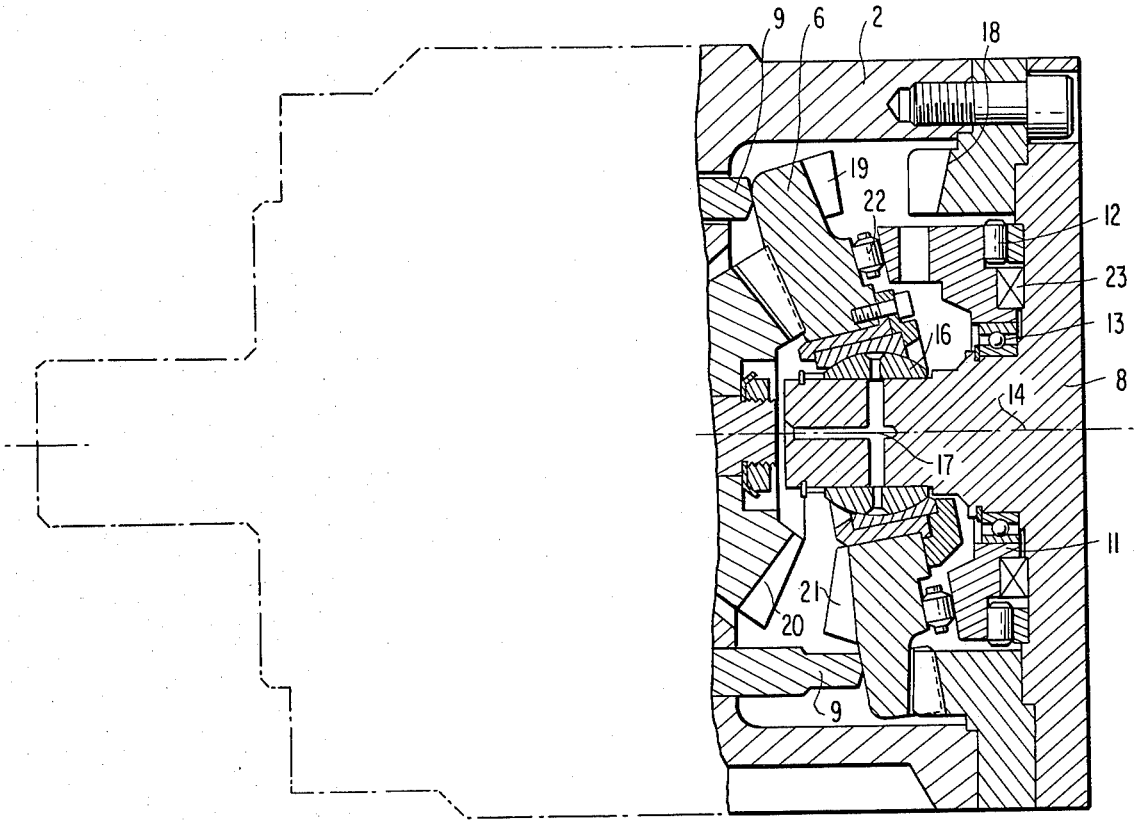
FIG. 2 is a fragmentary, sectional view of a second embodiment of the present invention.

Second Embodiment, FIG. 2

In FIG. 2 there is shown a second embodiment of the present invention which is substantially similar in construction to the first embodiment described hereinbefore with reference to FIG. 1 except that electromagnetic or hydraulic brakes 23 are interposed between the front end plate 8 and the swash plate 11. The brakes 23 may be actuated from the exterior so as to brake or retard the plate 11 in case of an emergency or the like, whereby the breakdown of the hydraulic motor may be avoided. For instance, when the supply of the working liquid should be suspended because of any cause such as an interruption of electric power supply, the hydraulic motor would be forced to reverse in rotation under the influence of the load so that an accident might occur. In this case, when the brakes 23 are immediately actuated to retard the rotation of the plate 11, the latter can arrest the motion or nutation of the nutating member 6 so that the hydraulic motor can be stopped.

It is advantageous to position the brakes 23 between the plate 11 and the front end cover 8 because brakes 23 with less braking power may be used. If a brake is provided to retard the rotation of the output shaft 1 it must have high braking power or capacity because the output shaft 1 is rotated at a low speed but at a high torque. On the other hand, the plate 11 is rotated at a high speed but at a low torque so that the brakes for retarding and arresting the motion of the disk 11 may have lower braking power or capacity.

Figure 3:
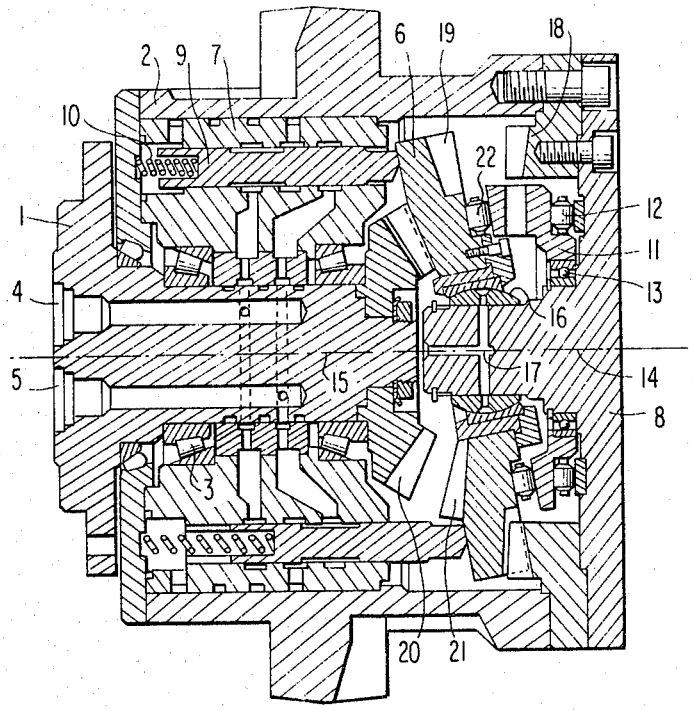
FIG. 3 is a longitudinal, sectional view of a third embodiment of the present invention.

Third Embodiment, FIG. 3

FIG. 3 shows a third embodiment of the present invention which is substantially similar in construction to the first embodiment described in detail hereinabove with reference to FIG. 1 except that the output shaft 1 is a stationary member while the casing 2 including its associated component parts is a moving member. Therefore both the high and low pressure ports 4 and 5 are formed in the output shaft 1 which is the stationary member.

The third embodiment is also similar in mode of operation to the first embodiment. That is, when the working liquid under high pressure is admitted through the high pressure port 4, the pistons 9 are extended and retracted in a predetermined sequence in the manner described elsewhere so that the nutating member 6 nutates. However, the bevel gear 20 is rigidly carried on the stationary output shaft 1 and is non-rotatable so that the rear bevel gear 21 on the nutating member 6 progressively meshes with the bevel gear 20 on the shaft 1 and rotates due to the reaction from the bevel gear 20. The rotation of the nutating member 6 is transmitted through the front bevel gear 19 thereon to the bevel gear 18 securely held between the casing 2 and the front end cover 8, whereby, as the bevel gear 18 is caused to rotate, the casing 2 is also rotated in unison therewith.

After having done work, the working liquid under high pressure drops in pressure and is discharged through the low pressure port 5. In order to reverse the rotation of the hydraulic motor, the high pressure liquid is admitted through the port 5 while the liquid under low pressure is discharged through the port 4 as in the case of the first embodiment. The third embodiment may be provided also with suitable braking means as in the case of the second embodiment in order to prevent an accident in case of a failure of high hydraulic pressure supply.

So far the liquid under high pessure has been used as the pressure fluid for driving the pistons 9 but it is to be understood that any fluid under pressure such as the air under pressure may be equally used. Furthermore it is to be understood that the hydraulic motors described above may be readily converted into the pumps when the rotating member, i.e., the output shaft 1 or the casing 2 is driven by an external prime mover. Then a fluid under low pressure is sucked through the low pressure port 5, compressed by the pistons 9 and is discharged through the high pressure port 4 as a fluid under high pressure.

In summary, the present invention provides a hydraulic motor or a hydraulically operated rotary machine incorporating therein a nutating bevel gear transmission train. The shaft 1 is supported in the main bearings 3 in the casing 2. The plate 11 with the obliquely oriented working surface is rotatably mounted with both the radial and thrust bearings 13 and 12 on the front end cover 8 within the casing 2 in such a way that the plate 11 is in coaxial relationship with the shaft 1. The short shaft protrudes from the front end plate 8 into the casing in coaxial relationship with both the shaft 1 and the plate 11, the spherical bearing 16 being mounted on this short shaft in such a way that the center of the radius of the spherical bearing surface thereof lie on the axis of the short shaft. The nutating member 6 with the front and rear bevel gears 19 and 21 is mounted on the spherical surface bearing 16 in such a way that the center of the nutation of the nutating member 6 may coincide with the center of the radius of the spherical bearing surface of the bearing 16 on the common axis 14 and that the front and rear bevel gears 19 and 21 on the nutating member 6 may mesh with the bevel gears 18 and 20, respectively. The bevel gear 18 may be held stationary to the casing 2 in coaxial relationship with the axis 14 of the plate 11 while the bevel gear 20 in mesh with the rear bevel gear 21 is rigidly carried on the shaft 1 at the front end thereof. The inclined rear end face of the plate 11 mounted for rotation about the axis 14 as described above is in rolling contact with the front end face of the nutating member 6 through the thrust bearing 22. Thus the shaft 1 may be a rotating member while the casing 2 may be a stationary member and vice versa.

The plate 11 can be supported with both the radial and thrust bearings 13 and 12 with high load carrying capacities so that the service life of the hydraulic motor may be considerably increased. Furthermore the nutating member 6 is mounted on the spherical bearing 16 so that the former may be more rigidly supported. As a consequence, the deflection and deviation of the nutating member 6 under load may be reduced to a minimum, vibration and noise may be also suppressed to a minimum and the high speed operation of the hydraulic motor may become feasible.

The present invention is further advantageous in that the number of component parts of the nutating type transmission train may be minimized with the resulting reduction in cost, but it must be emphasized that the reduction in number of component parts is not made at a sacrifice of strength of the bevel gears in the transmission or train. The bevel gears themselves may be increased considerably in strength. Thus the hydraulic motor in accordance with the present invention may be made very simple in construction and compact in size yet highly reliable and dependable in operation.

In addition, the nutation of the nutating member 6 is guided by the plate 11 having the obliquely oriented mating surface in rolling contact with the nutating member 6 through the thrust bearing 22. As a result, timing adjustment of the pistons 9 is facilitated and simplified, which pistons must be extended and retracted in a predetermined sequence in very precisely timed relationship. Moreover, the assembly of the pistons 9 with their associated component parts may be remarkably simplified. The timing variation of the pistons over long periods of operation may be also reduced to such an extent hithertobefore impossible by the prior art.

Moreover relatively large space is available for supporting the shaft 1 so that the main shaft bearings 3 with a high load carrying capacity may be advantageously used and the distance between the axially spaced apart bearings 3 may be sufficiently increased. As a consequence the hydraulic motors with high capacity may be designed and fabricated in a simple manner.

What is claimed is:

1. In a hydraulically operated rotary machine of the type incorporating therein a nutating bevel gear transmission train, said machine comprising a casing member, a shaft member journalled in said casing member, main bearing means interposed between said casing member and said shaft member such that one of said members is stationary while the other member is rotary or vice versa, a low pressure port and a high pressure port formed in said stationary member, a nutating member disposed for nutation in said casing member in coaxial relationship with said shaft member and including a first bevel gear and a second bevel gear, said first bevel gear being in mesh with a bevel gear mounted on said casing member, said second bevel gear being in mesh with a bevel gear carried by said shaft member and having a different number of teeth from that of the bevel gear carried by said shaft member, and a valve unit disposed within said casing member and including a plurality of pistons each of which is slidably disposed in said machine for reciprocal movement in the longitudinal direction of said casing member and functioning as a spool of a three-way valve, the pistons having free ends extending out of said valve unit and abutting against said nutating member, whereby the reciprocal movement of each of said pistons and the nutation of said nutating member operates such that a space behind the end of said piston remote from said free end thereof varies in volume, said hydraulic machine further comprising a swash plate having an inclined end face and being mounted by means of thrust and radial bearing means within said casing member for rotation in coaxial relationship with said shaft member, spherical surface bearing means with a spherical bearing surface mounted within said casing member in coaxial relationship with said shaft, between said pistons and said swash plate, said nutating member being carried by said spherical bearing means such that the center of the nutation of said nutating member coincides with the center of radius of the spherical bearing surface of said spherical bearing, and thrust bearing means interposed between said nutating member and said inclined end face of said swash plate, with said thrust bearing means being mounted on said nutating member.

2. A hydraulic machine as defined in claim 1, wherein said shaft member comprises the rotary member while said casing member comprises the stationary member and is formed with said high and low pressure ports, whereby, when said pistons are extended and retracted in a predetermined sequence they cause the nutation of said nutating member which in turn causes the rotation of said bevel gear carried by said shaft and thus the rotation of said shaft.

3. A hydraulic machine as defined in claim 1, wherein said shaft comprises the stationary member and is formed with said high and low pressure ports while said casing member comprises the rotary member, whereby, when said pistons are caused to extend and retract in a predetermined sequence, they cause the nutation of said nutating member which in turn causes the rotation of said casing through the engagement of said first bevel gear on said nutating member with said bevel gear mounted on said casing.

4. A hydraulic machine as defined in claim 1, wherein at least one brake means is interposed between said swash plate and said casing member so as to retard and arrest the motion of said swash plate.

5. A hydraulic machine as defined in claim 1, wherein said swash plate is rotatably mounted on a protrusion extending coaxial with said shaft member from a cover forming a part of the casing member.

* * * * *